US006021895A

United States Patent [19]

Wu

[11] Patent Number: 6,021,895

[45] Date of Patent: Feb. 8, 2000

[54] CLUB RACK AND GOLF BAG ARRANGEMENT

[76] Inventor: David Wu, No. 35-1, Jih Hsin Street, Tu Cheng Hsiang, Taipei Hsien, Taiwan

[21] Appl. No.: 09/229,983

[22] Filed: Jan. 14, 1999

[51] Int. Cl.[7] ..... A63B 55/00

[52] U.S. Cl. ..... 206/315.3; 206/315.6; 211/70.2

[58] Field of Search ..... 206/315.3, 315.6, 206/315.5; 211/70.2

[56] References Cited

U.S. PATENT DOCUMENTS 2,551,780 5/1951 Wood ..... 206/315.3

5,755,322 5/1998 Yang ..... 211/70.2 X 5,868,247 2/1999 Schrader ..... 206/315.4

*Primary Examiner*—Gary E. Elkins

*Assistant Examiner*—Tri M. Mai

*Attorney, Agent, or Firm*—Varndell & Varndell, PLLC

[57] ABSTRACT

A club rack and golf bag arrangement includes a golf bag having expansible peripheral wall portions, a fixed club rack fixedly fastened to the golf bag on the inside at the top, and a movable club rack pivoted to the fixed club rack and moved between a closed position where the movable club rack is closed attached to the fixed club rack, and an extended position where the movable club rack is extended outwards from the fixed club rack and the expansible peripheral wall portions of the golf bag are expanded for easy loading/unloading of golf clubs.

2 Claims, 10 Drawing Sheets

CLUB RACK AND GOLF BAG ARRANGEMENT

BACKGROUND AND SUMMARY OF THE INVENTION

The present invention relates to golf bags, and more specifically to a club rack and golf bag arrangement in which the upper part of the golf bag can be expanded for easy loading/unloading of golf clubs.

A regular golf bag, as shown in FIG. 1, is generally equipped with a club rack within its top cuff for holding golf clubs inside the bag in a good order. Because the top cuff of the golf bag is not expansible, it is inconvenient to insert golf clubs into, or removed golf clubs from the club rack inside the golf bag.

The present invention has been accomplished to provide a club rack and golf bag arrangement in which the golf bag can be pulled to expand its upper part for easy loading/unloading of golf clubs. According to the preferred embodiment of the present invention, the club rack and golf bag arrangement comprises a golf bag, which has expansible peripheral wall portions provided at two opposite sides, a fixed club rack fixedly fastened to the inside of the top cuff of the golf bag, a movable club rack pivoted to the fixed club rack a control bar coupled to a bracket inside the movable club rack and Pulled by hand to move the movable club rack between a closed position and an extended position.

DETAILED DESCRIPTTON OF THE PREFERRED EMBODIMENT

Figure 1:
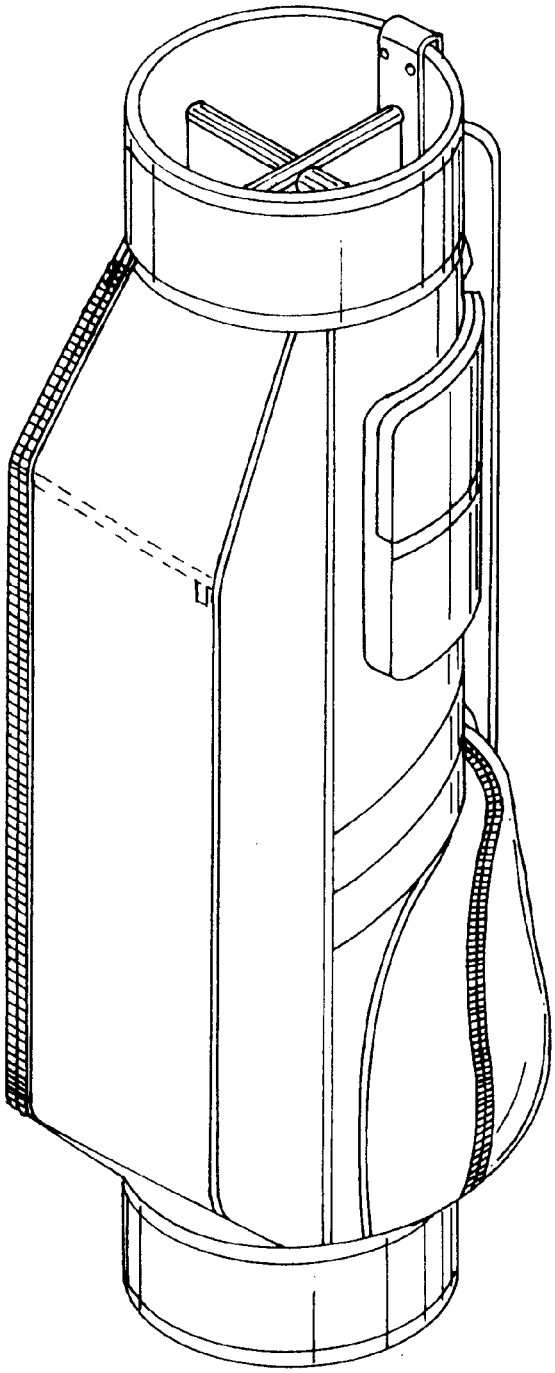
Fig. 1 PRIOR ART
FIG. 1 is a perspective view of a golf bag according to the prior art.

Referring to FIGS. from 2 through 10, a club rack and golf bag arrangement in accordance with the present invention is generally comprised of a fixed club rack 1, a movable club rack 2, a control bar 3, two spring members 5, and a golf bag 7.

The fixed club rack 1 is allow frame fixedly fastened to the inside of the upper part (top cuff) 71 of the golf bag 7, having two downwardly extended bottom coupling walls 11 arranged in parallel at its bottom side, and two locating rods 111 respectively provided at the bottom coupling walls 11 near the top.

Figure 3:
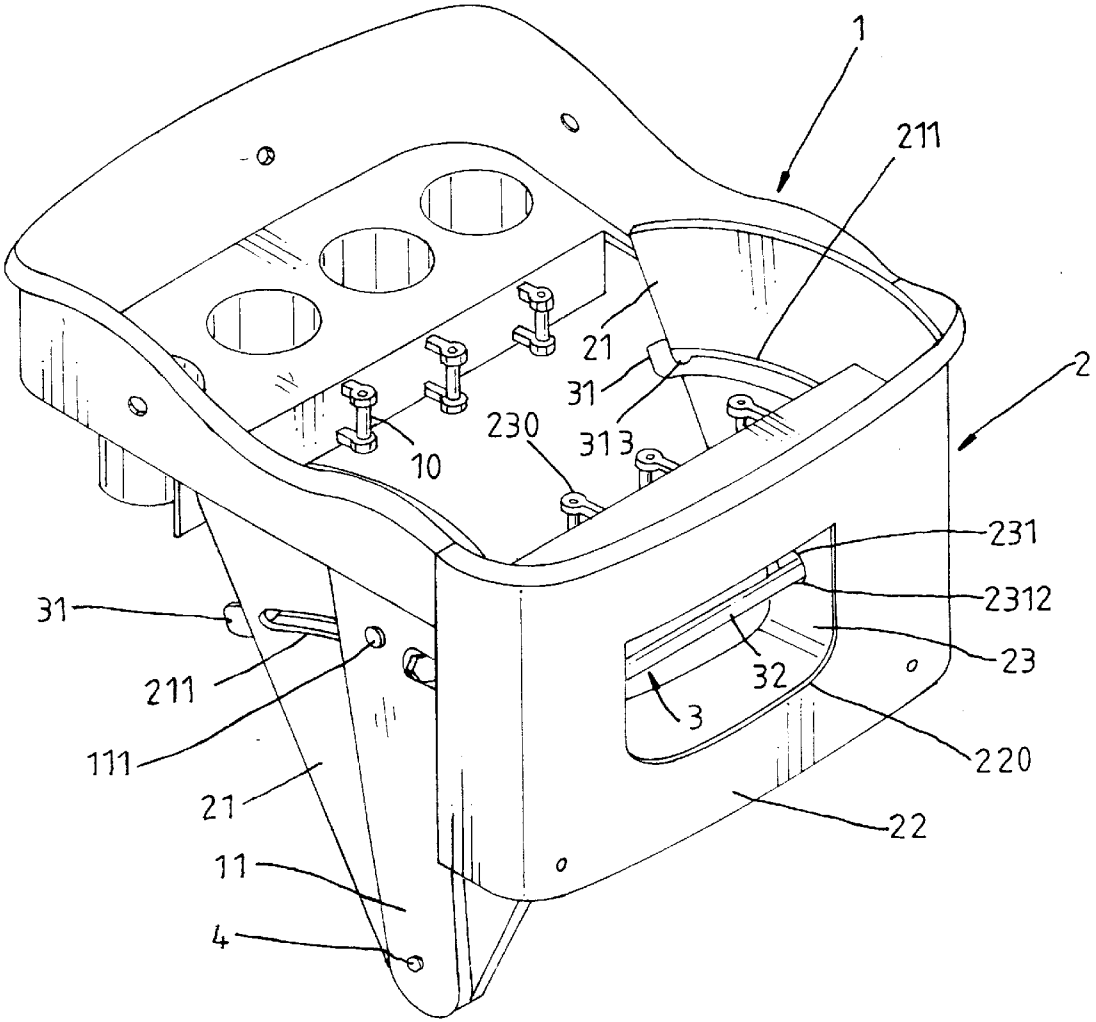
FIG. 3 is an assembly view of the movable club rack, the fixed club rack, and the control bar according to the present invention.
Figure 4:
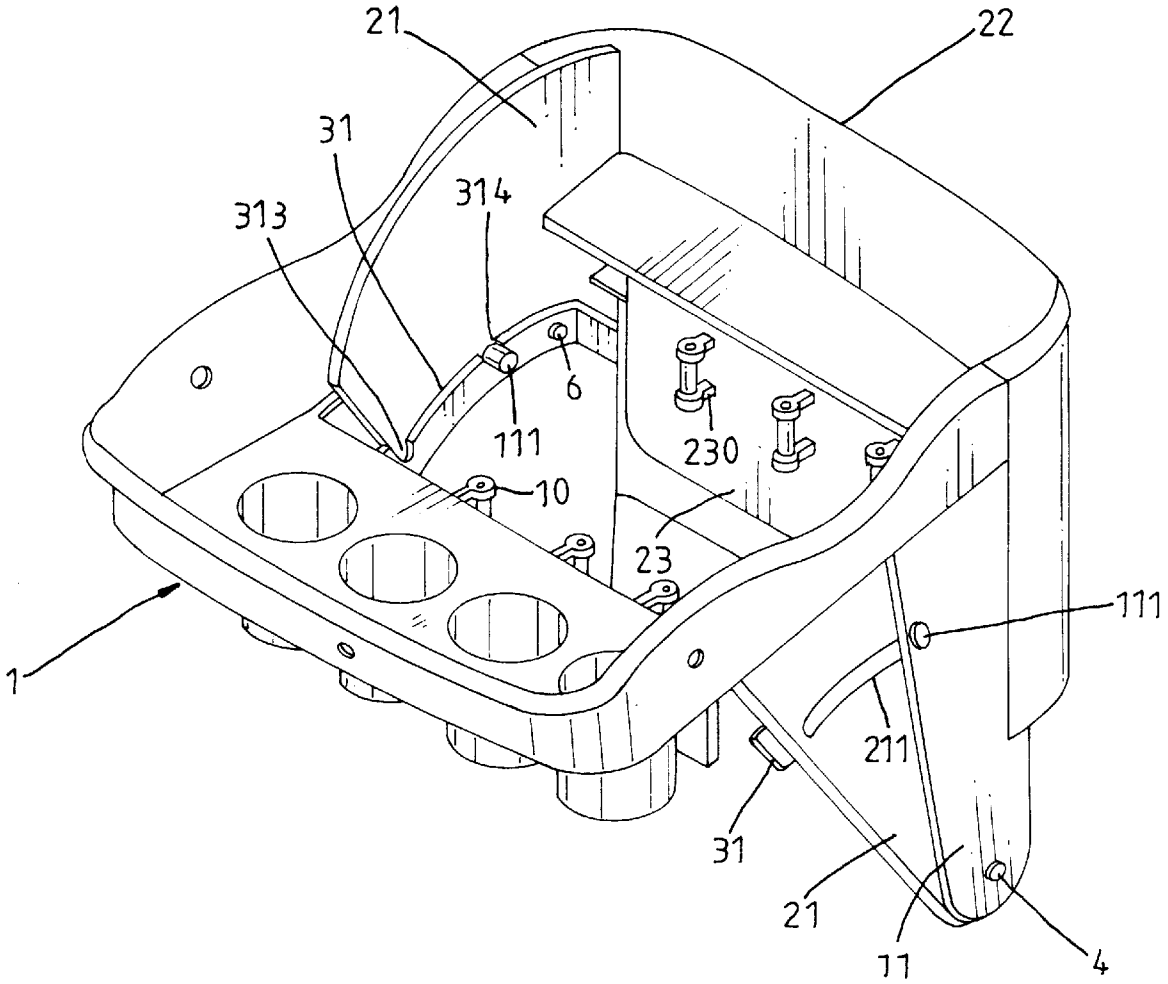
FIG. 4 shows the assembly of FIG. 3 viewed from another direction.
Figure 5:
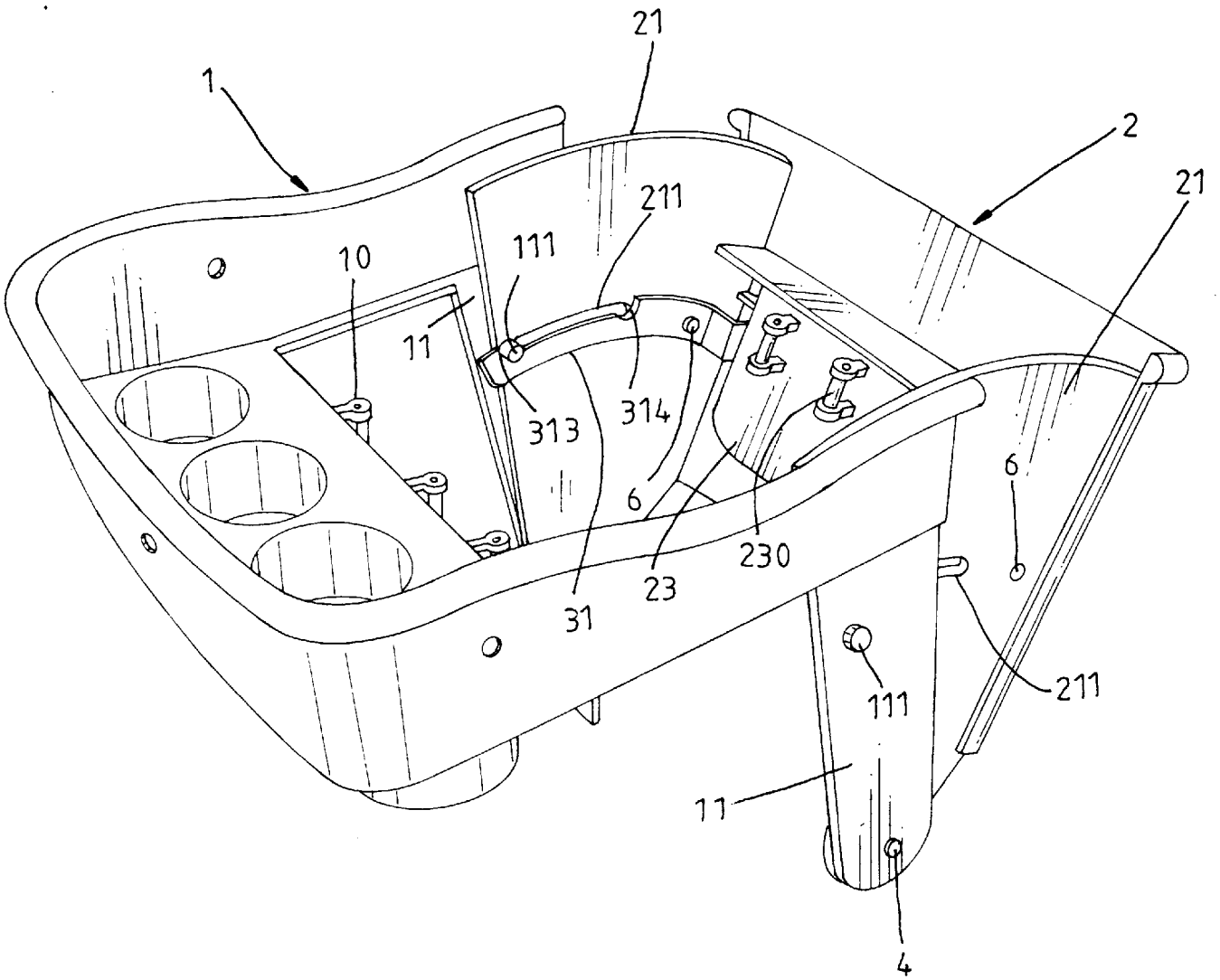
FIG. 5 shows the movable club rack of the assembly of FIG. 3 moved to the extended position.

The movable club rack 2 comprises a base wall 22, two substantially sector-like walls 21 bilaterally perpendicularly raised from the base wall 22 in same direction, and a bracket 23 mounted in the base wall 22. The section-like side walls 21 are respectively pivoted to the bottom coupling walls 11 of the fixed club rack 1 by a respective pivot 4, each having a transverse sliding slot 211 respectively coupled to the locating rod 111 at the bottom coupling walls 11 of the fixed club rack 1 for enabling the movable club rack 2 to be moved between a closed position where the base wall 22 of the movable club rack 2 is closely attached to the fixed club rack 1 as shown in FIG. 4, and an extended position where the base wall 22 of the movable club rack 2 is spaced from the fixed club rack 1 at a distance as shown in FIG. 5, and a respective Pivot 6. The base wall 22 of the movable club rack 2 comprises an opening 220 on the middle, and two locating holes 221 bilaterally disposed near the bottom (see FIG. 6). The bracket 23 is mounted in the opening 220 at the base wall 22 of the movable club rack 2, having two oblique holes 231 respectively disposed at two opposite side walls thereof (see FIGS. 2 and 3).

The control bar 3 is comprised of two parallel end bars 31, and a pull rod 32 connected between the parallel end bars 31. The end bars 31 are respectively pivoted to the pivots 6 at the side walls 21 of the movable club rack 2. The pull rods 32 is inserted through the oblique holes 231 at the bracket 23. The end bars 31 each comprise a locating hole 312 adjacent to the pull rod 32, a first retaining notch 313 and a second retaining notch 314 alternatively set into engagement with the locating rods 111 at the bottom coupling walls 11 of the fixed club rack 1.

Figure 6:
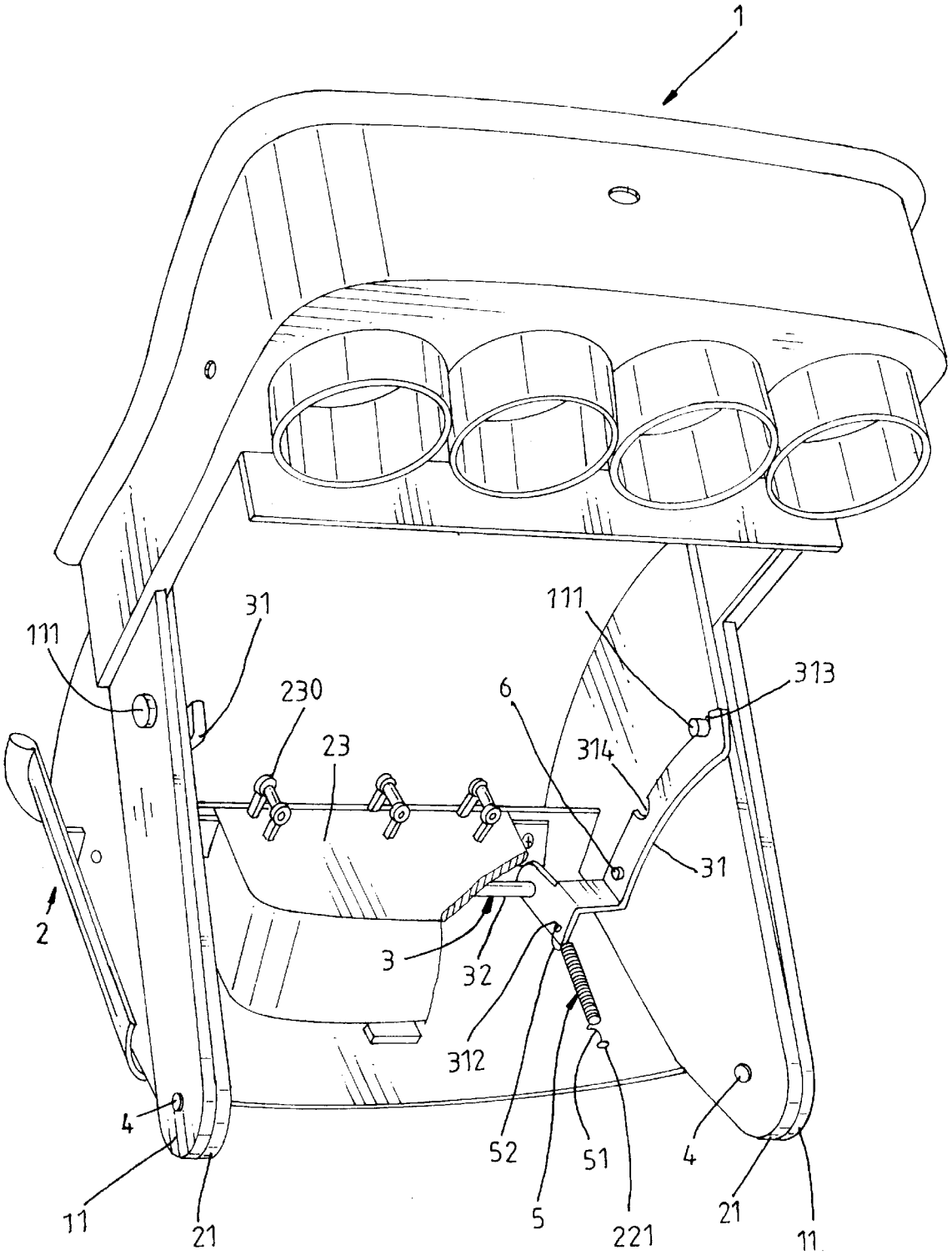
FIG. 6 is an enlarged view of FIG. 5 when viewed obliquely from the bottom side.
Figure 7:
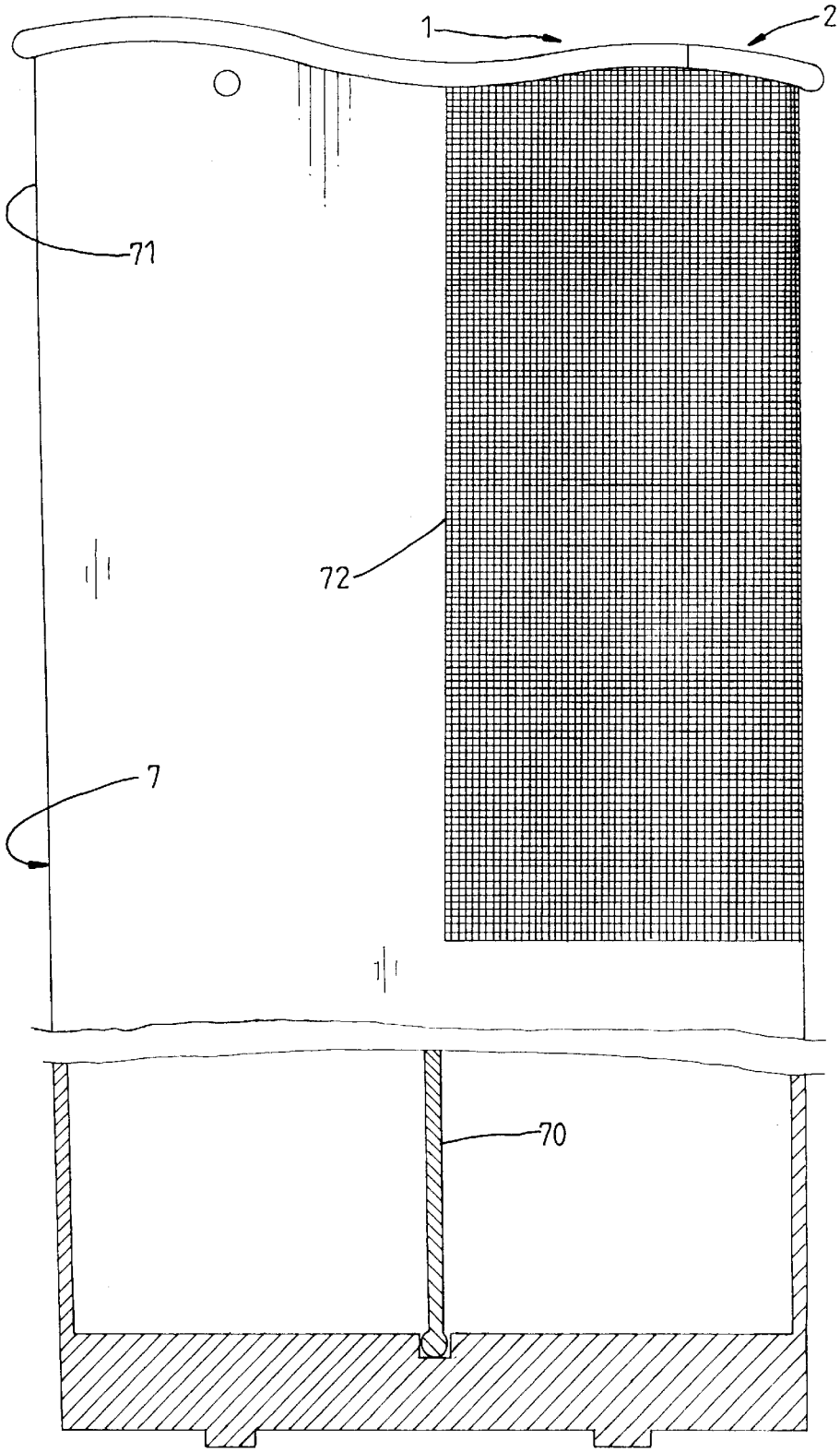
FIG. 7 is a side view partially in section of the golf bag according to the present invention.

The spring members 5 each have one end 51 respectively connected to the locating holes 221 at the base wall 22 of the movable club rack 2, and an opposite end 52 respectively connected to the locating holes 312 at the end bars 31 of the control bar 3 (see FIG. 6). The spring members 5 impart a downward pressure to the pull rod 32 of the control bar 3, causing the pull rod 32 of the control bar 3 to be secured to the bottom ends 2312 of the oblique holes 231 at the bracket 23 (see FIG. 2).

Figure 2:
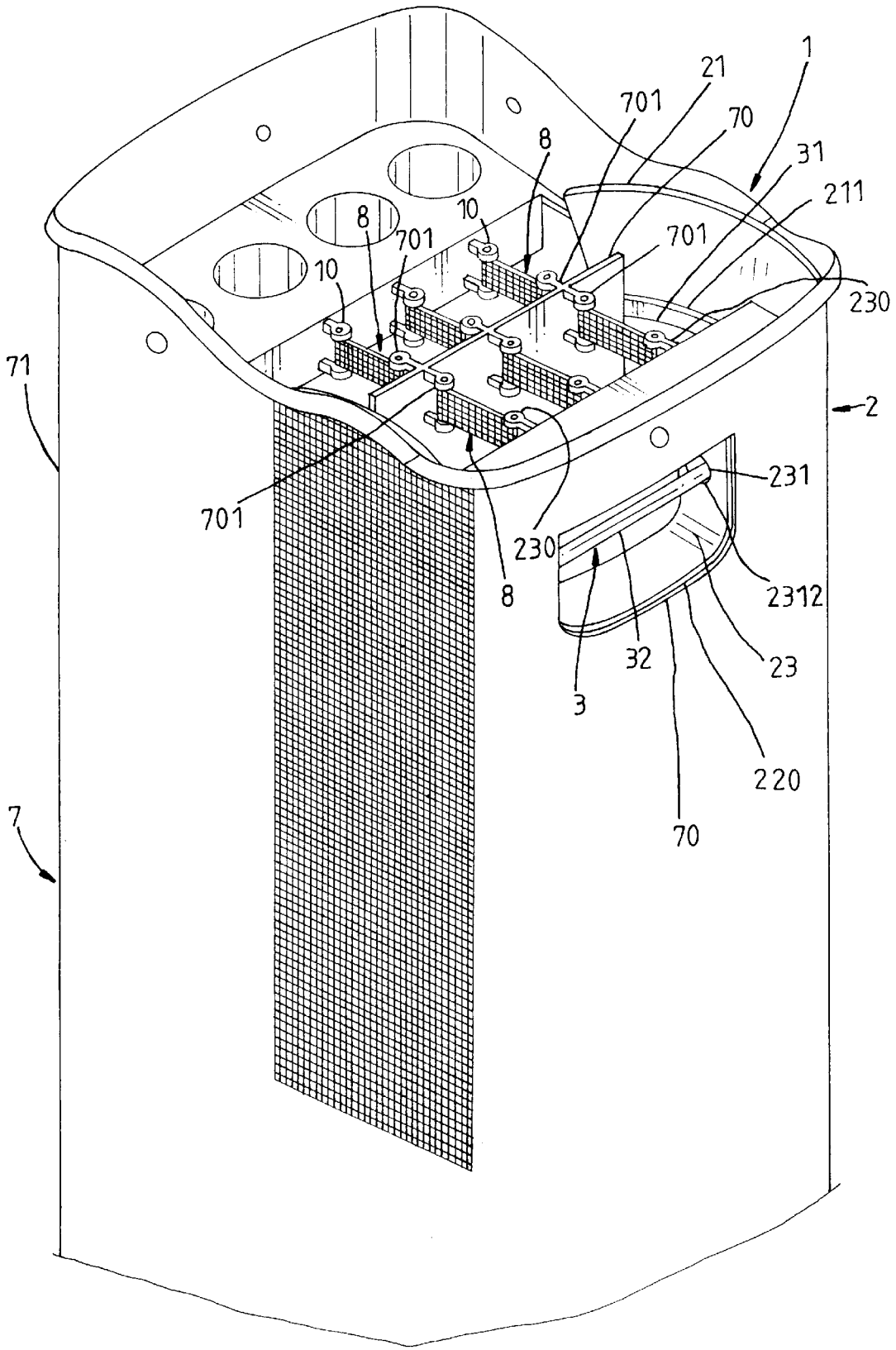
FIG. 2 is a perspective view of the preferred embodiment of the present invention.

The golf bag 7 has its upper part (top cuff) 71 fixedly fastened to the outside wall of the fixed club rack 2, expansible peripheral wall portions 72 provided at two opposite sides, that are expanded when the movable club rack 2 is moved to the extended position (see FIGS. 5 and 8), and an opening 70 at its front side corresponding to the opening 220 at the base wall 22 of the movable club rack 2 (see FIG. 2).

Figure 8:
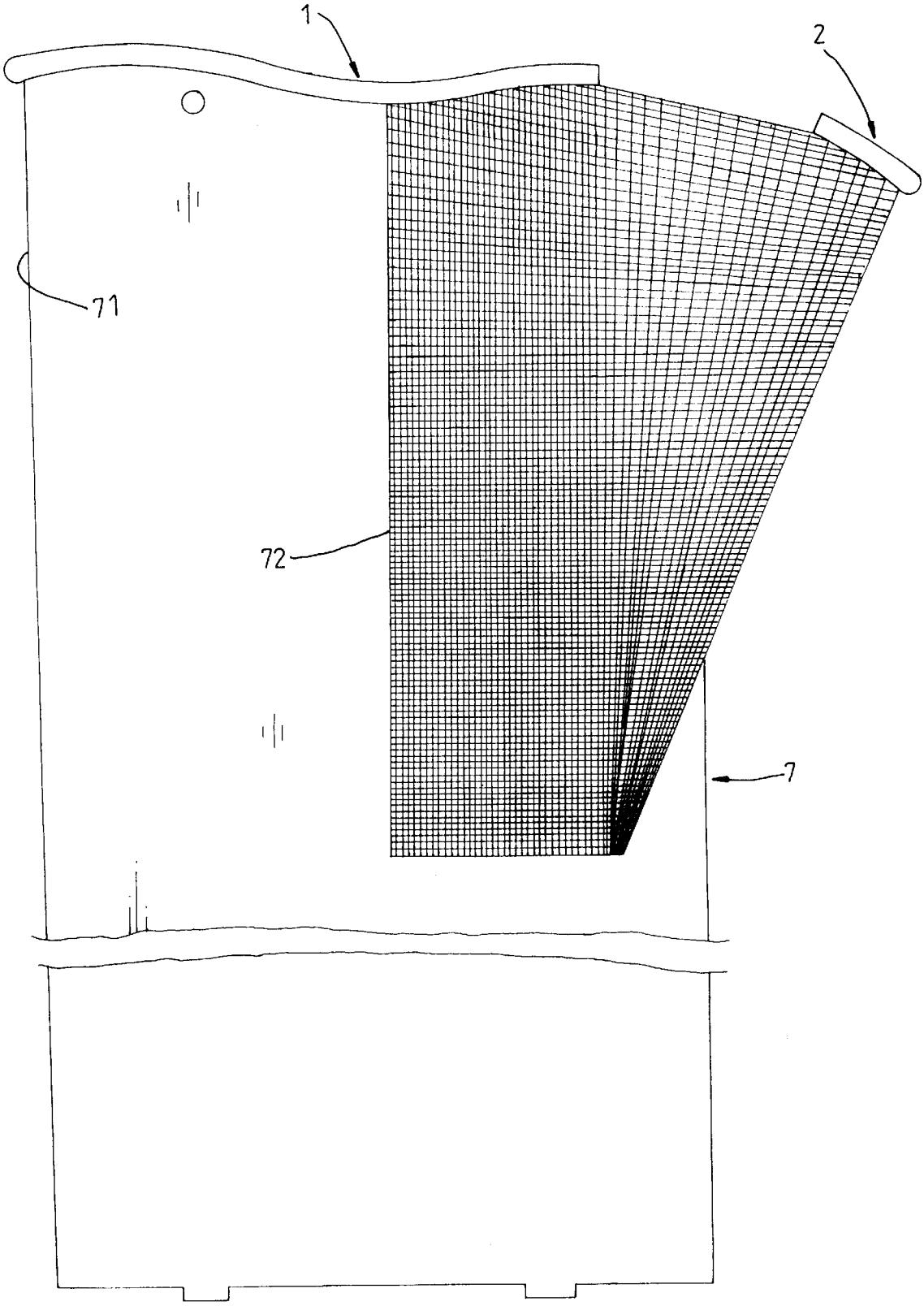
FIG. 8 shows the expansible peripheral wall portions of the golf bag expanded according to the present invention.
Figure 9:
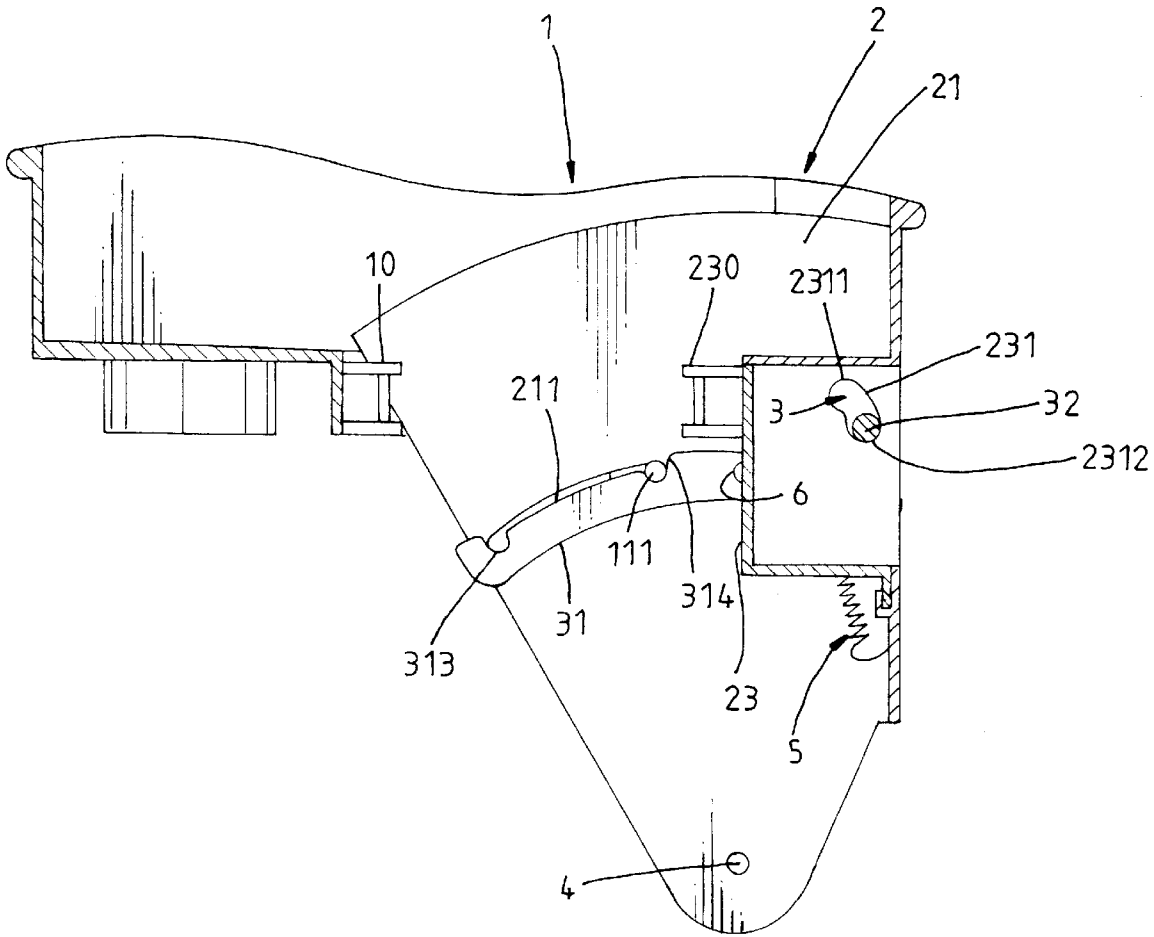
FIG. 9 is a sectional view of a part of the present invention, showing the positioning of the control bar in the bracket at the movable club rack.
Figure 10:
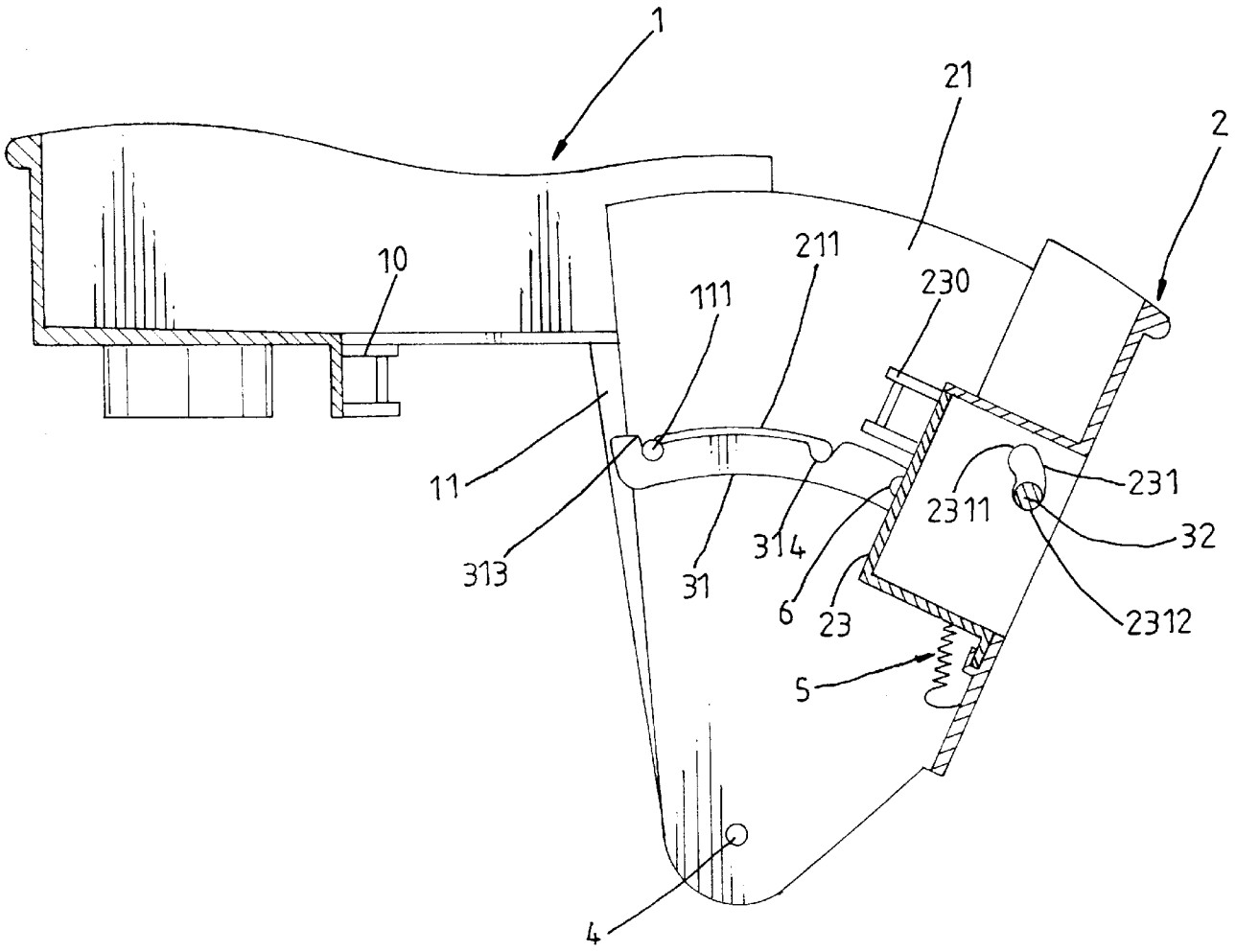
FIG. 10 is similar to FIG. 9 but showing the movable club rack closed on the fixed club rack.

When the pull rod 32 of the control bar 3 is pulled upwards and moved from the bottom ends 2312 of the oblique holes 231 at the bracket 23 to the top ends 2311 thereof, the end bars 31 of the control bar 3 are respective turned downwardly about the respective pivots 6 to disengage the respective second retaining notches 314 from the respective locating rods 111, enabling the, movable club rack 2 to be pulled outwards from the fixed club rack 1 to be extended position and the expansible peripheral wall portions 72 of the golf bag 7 to be expanded (see FIG. 8). When the movable club rack 2 is moved to the extended position, the pull force is released from the pull rod 32, enabling the control bar 3 to be pulled downwards by the spring members 5 into engagement with the bottom ends 2312 of the oblique holes 231, and at the same time the end bars 31 of the control bar 3 are turned upwards to force the respective first retaining notches 313 into engagement with the respective locating rods 111, and therefore the movable club rack 2 is locked in the extended position (see FIGS. 5, 6, 8 and 10). When returning the movable club rack 2 to the closed position, the pull rod 32 is Pulled upwards to turn the end bars 31 about the respective pivots 6 and disengage the first retaining notches 313 from the respective locating rods 111 for enabling the movable club rack 2 moved back from the extended position to the closed position. When the movable club rack 2 is moved to the closed position, the pull rod 31 is released from the hand and pulled downwards by the spring members 5 into engagement with the bottom ends 2312 of the oblique holes 231, and at the same time the end bars 31 of the control bar 3 are turned upwards to force the respective second retaining notches 313 into engagement with the respective locating rods 111, and therefore the movable club rack 2 is locked in the closed position (see FIGS. 3, 4, 7 and 9).

Referring to FIGS. 2 and 7 again, a partition wall 70 is mounted in the golf bag 7. A plurality of locating blocks 701, 10, and 230 are respectively provided at the top of the partition wall 70, the inside of the fixed club rack 1 and the inside of the bracket 23. A plurality of elastic bands 8 are respectively connected between the locating blocks 701 and the locating blocks 10 and 230 at the fixed club rack 1 and the bracket 23.

Because the golf bag 7 has expansible peripheral wall portions 72, its top cuff can be expanded for enabling golf clubs to be conveniently inserted into or pulled out of the golf bag 7.

I claim:

1. A club rack and golf bag arrangement comprising:

a golf bag, said golf bag comprising a top cuff, expansible peripheral wall portions provided at two opposite sides, and an opening at a front side thereof;

a fixed club rack fixedly fastened to the inside of the top cuff of said golf bag, said fixed club rack comprising two downwardly extended bottom coupling walls arranged in parallel at a bottom side thereof, and two locating rods respectively provided at said bottom coupling walls at an upper location;

a movable club rack coupled to said fixed club rack, said movable club rack comprising a base wall, two substantially sector-like side walls bilaterally perpendicularly raised from said base wall in same direction and respectively pivoted to the bottom coupling walls of said fixed club rack by a respective pivot, and a bracket mounted in said base wall, said sector-like side walls each having a transverse sliding slot respectively coupled to the locating rod at the bottom coupling walls of said fixed club rack for enabling said movable club rack to be moved between a closed position where the base wall of said movable club rack is closely attached to said fixed club rack, and an extended position where the base wall of said movable club rack is spaced from said fixed club rack at a distance, and a respective pivot, said base wall of said movable club rack comprising an opening on the middle aimed at the opening at the front side of said golf bag, and two locating holes bilaterally disposed near a bottom side, said bracket being fixedly mounted in the opening at said base wall of said movable club rack and having two oblique holes respectively disposed at two opposite side walls thereof;

a control bar coupled to said bracket and Pulled by hand to move said movable club rack between said closed position and said extended position, said control bar comprised of two parallel end bars, and a pull rod connected between said parallel end bars, said end bars being respectively pivoted to the pivots at the side walls of said movable club rack, said pull rod being inserted through the oblique holes at said bracket, said end bars each comprising a locating hole adjacent to said pull rod, a first retaining notch and a second retaining notch alternatively set into engagement with the locating rods at the bottom coupling walls of said fixed club rack to lock said movable club rack in said closed position or said extended position; and two spring members connected between said control bar and said movable rack to pull said control bar downwards, said spring members each having one end respectively connected to the locating holes at the base wall of said movable club rack, and an opposite end respectively connected to the locating holes at the end bars of said control bar;

wherein the pull rod of said control bar can be pulled upwards and moved along the oblique holes at said bracket to turn said end bars about the respective pivots, enabling the first retaining notches and the second retaining notches to be selectively set into engagement with the locating rods at said fixed club rack to lock said movable club rack in the closed position or extended position.

2. The club rack and golf bag arrangement of claim 1 wherein said golf bag comprises a partition wall suspended in between said movable club rack and said fixed club rack, a plurality of locating blocks respectively provided at said partition wall at a top side, and a plurality of elastic bands respectily connected between the locating blocks at said partition wall and respective locating blocks at said fixed club rack and said bracket.

* * * * *